US011434719B2

(12) United States Patent
Al-Abdulmohsin et al.

(10) Patent No.: US 11,434,719 B2
(45) Date of Patent: Sep. 6, 2022

(54) TUBING CASING ANNULUS VALVE

(71) Applicant: Saudi Arabian Oil Company, Dhahran (SA)

(72) Inventors: Yousif Al-Abdulmohsin, Udhiliyah (SA); Haider Al-Hajji, Udhiliyah (SA)

(73) Assignee: Saudi Arabian Oil Company, Dhahran (SA)

( * ) Notice: Subject to any disclaimer, the term of this patent is extended or adjusted under 35 U.S.C. 154(b) by 56 days.

(21) Appl. No.: 17/163,720

(22) Filed: Feb. 1, 2021

(65) Prior Publication Data

US 2022/0243555 A1 Aug. 4, 2022

(51) Int. Cl.
*E21B 34/02* (2006.01)
*E21B 47/06* (2012.01)

(52) U.S. Cl.
CPC ..... *E21B 34/025* (2020.05); *E21B 47/06* (2013.01)

(58) Field of Classification Search
CPC ..... E21B 34/025; E21B 34/16
See application file for complete search history.

(56) References Cited

U.S. PATENT DOCUMENTS 3,642,070 A 2/1972 Taylor et al.
3,860,066 A 1/1975 Pearce et al.
4,125,162 A * 11/1978 Groves, Sr. ..... E21B 19/22 166/368
4,467,867 A 8/1984 Baker
5,343,941 A * 9/1994 Raybon ..... E21B 37/06 166/66.6
7,308,943 B2 12/2007 Hopper et al.
9,127,547 B2 * 9/2015 Prukop ..... B01D 17/0202
10,253,585 B2 4/2019 Hickie
2002/0144953 A1 * 10/2002 Kerfoot ..... B09C 1/002 210/741
2003/0164240 A1 * 9/2003 Vinegar ..... E21B 47/13 137/155

(Continued)

FOREIGN PATENT DOCUMENTS

EP 1718841 B1 2/2008

OTHER PUBLICATIONS

Brodie, Alan; "The Autonomous Management of Wells with Unplanned Sustained Casing Pressure" SPE-183077-MS, Abu Dhabi International Petroleum Exhibition & Conference, Abu Dhabi, UAE, Nov. 7-10, 2016; pp. 1-13.

*Primary Examiner* — Shane Bomar
(74) *Attorney, Agent, or Firm* — Bracewell LLP; Constance G. Rhebergen; Brian H. Tompkins

(57) ABSTRACT

Provided is a hydrocarbon well tubing casing annulus (TCA) control valve system that includes a TCA flowline to direct TCA fluid expelled from a TCA of a hydrocarbon well system to a collection facility, a TCA control valve to regulate the flow of the TCA fluid in the TCA flowline, a TCA sample port to enable sampling of the TCA fluid expelled, a TCA check valve to facilitate forward flow of the TCA fluid, a TCA pressure sensor to sense pressure of the TCA, and a TCA control system to: receive (from the TCA pressure sensor) a sensed pressure of the TCA, determine (based on the sensed pressure of the TCA) that a pressure of the TCA is below a threshold TCA pressure, and, in response, control the TCA control valve to operate in a closed position.

20 Claims, 4 Drawing Sheets

(56) References Cited

U.S. PATENT DOCUMENTS

| | | | | |
|---|---|---|---|---|
| 2005/0051329 | A1* | 3/2005 | Blaisdell | E21B 49/084 166/264 |
| 2008/0237141 | A1* | 10/2008 | Kerfoot | E21B 21/068 210/150 |
| 2018/0313187 | A1 | 11/2018 | Cummins | |
| 2019/0368299 | A1* | 12/2019 | Jorud | E21B 21/08 |
| 2022/0098971 | A1* | 3/2022 | Raglin | E21B 47/047 |

* cited by examiner

TUBING CASING ANNULUS VALVE

FIELD

Embodiments relate generally to developing wells, and more particularly to hydrocarbon well tubing casing annulus monitoring and regulation.

BACKGROUND

A well typically includes a wellbore (or a "borehole") that is drilled into the Earth to provide access to a geologic formation that resides below the Earth's surface (or a "subsurface formation"). A well may facilitate the extraction of natural resources, such as hydrocarbons and water, from a subsurface formation, facilitate the injection of substances into the subsurface formation, or facilitate the evaluation and monitoring of the subsurface formation. In the petroleum industry, hydrocarbon wells are often drilled to extract (or "produce") hydrocarbons, such as oil and gas, from subsurface formations.

Developing a hydrocarbon well for production typically involves several stages, including drilling, completion and production stages. The drilling stage involves drilling a wellbore into a portion of the formation that is expected to contain hydrocarbons (often referred to as a "hydrocarbon reservoir" or a "reservoir"). The drilling process is often facilitated by a drilling rig that sits at the Earth's surface to facilitate drilling operations, such as operating a drill bit to cut the wellbore. The completion stage involves operations for making the well ready to produce hydrocarbons, such as installing casing, production tubing, and valves for regulating production flow, and pumping substances into the well to fracture, clean or otherwise prepare the well to produce hydrocarbons. The production stage involves producing hydrocarbons from the reservoir by way of the well. During the production stage, the drilling rig is typically replaced with a production tree that includes conduits and valves that are operable to, for example, regulate pressure and flow in the wellbore, or provide access to the wellbore. The production tree is typically coupled to a wellhead, and operates to route the well's production to a distribution network of midstream facilities, such as tanks, pipelines or transport vehicles that transport the production to downstream facilities, such as refineries or export terminals.

The various stages of developing a hydrocarbon well can include a variety of challenges that are addressed to successfully develop the well. For example, during production operations, a well operator typically monitors and controls various aspects of the well system to optimize the overall production of hydrocarbons from the well. In many instances, this involves monitoring the pressure and isolation of different regions within the well system.

SUMMARY

Monitoring, controlling and maintaining a hydrocarbon well can be an important aspect of effectively and efficiently developing a hydrocarbon well. For example, valves, seals and conduits can be important for regulating, isolating and directing the flow of wellbore fluids, such as production fluid. Components of hydrocarbon wells, such as well production trees and associated valves, typically include sealing elements that provide a barrier to inhibit the passage of substances between different regions within the well system. For example, a ring shaped wellhead seal assembly may be disposed between the interior of a tubular casing pipe and an exterior of production tubing disposed in the casing pipe, to provide a seal that isolates fluids within the annular region surrounding the production tubing (often referred to as the "Tubing Casing Annulus" or "TCA"). This can inhibit comingling of the fluid of the TCA (or "TCA fluid") with production fluid traveling in the production tubing.

The annular region between production tubing and casing pipe (or "TCA") can experience pressure variations due to TCA fluid thermal expansion or fluid communication between the TCA and the wellbore. It is generally desirable to keep the TCA pressure ($P_{TCA}$) within an acceptable range (e.g., 0 pounds-per-square-inch (psi)$<P_{TCA}<$300 psi). A TCA valve is often provided on the production tree of a well to regulate pressure in the TCA or provide access to TCA fluid sample. For example, a TCA valve on a production tree of a well may be opened to "bleed-off" excessive TCA pressure, or to acquire samples of TCA fluid that can be assessed for the presences of foreign substance (e.g., oil and gas) in the TCA (which may signal a well integrity issue, such as fluid communication with the wellbore). Unfortunately, conventional TCA valve configurations can be difficult to use and potentially hazardous. For example, the TCA valve typically includes a manually operated valve that is manually opened and closed. When the TCA valve is opened, the TCA pressure can drop significantly before the valve can be closed. In the case of the pressure dropping below a desired level (e.g., below 0 psi), time consuming and costly corrective operations, such as pumping by a surface pump, may be needed to bring the pressure back to a desirable level. This can be common where the TCA fluid is an incompressible fluid. Further, when the TCA valve is opened TCA fluid may be released into the environment. This may be especially true where the TCA pressure is relatively high.

Provided in some embodiment is a "smart" TCA control valve system that provides for automated monitoring and regulation of the TCA pressure. Embodiments include a TCA control valve that automatically opens or closes based on TCA pressure. For example, the TCA control valve may automatically close when the TCA pressure falls below a threshold, which can prevent the TCA pressure from falling so low that corrective operations, such as pumping, are required. The TCA control valve may automatically open when the TCA pressure is above a threshold, which can prevent the TCA pressure from rising so high that corrective operations, such as manual bleeding, are required. In some embodiments, the TCA valve system includes the following: (1) a TCA control valve (e.g., an automated valve that is positioned to regulate the flow of TCA fluid from a TCA of a well, and that automatically closes to inhibit TCA fluid backflow into the TCA when the TCA pressure is below a predefined lower TCA pressure threshold or that automatically opens when the TCA pressure is above a predefined upper TCA pressure threshold); (2) a TCA sample port (e.g., a needle valve that provides a sealed connection for the collection of TCA fluid samples downstream of the TCA control valve); (3) a TCA flowline (e.g., a piped connection that directs TCA fluid expelled from the TCA to a collection facility, such as dumping pit); and (4) a TCA flowline check valve (e.g., an in-line check valve on the TCA flowline that inhibits backflow of TCA fluid in the TCA flowline). In some embodiments, the TCA pressure thresholds are defined by an operator. The lower TCA pressure threshold (or "TCA closing pressure") may be 0 psi or greater in an effort to maintain a positive pressure in the TCA. In some embodiments, the upper TCA pressure threshold (or "TCA opening pressure") is greater than the lower TCA pressure threshold (e.g., upper TCA pressure threshold=300 psi, and lower TCA pressure threshold=0 psi). This may facilitate the TCA pressure being increased to be above the upper TCA pressure threshold before the TCA control valve is re-opened (after closing). In some embodiments, the upper TCA pressure threshold is the same as the lower TCA pressure threshold (e.g., upper TCA pressure threshold=lower TCA pressure threshold=0 psi). This may facilitate the TCA control valve re-opening (after closing) when the TCA pressure returns to the lower TCA pressure threshold.

Provided in some embodiments is a hydrocarbon well TCA control valve system that includes the following: a TCA flowline adapted to direct TCA fluid expelled from a TCA of a hydrocarbon well system to a collection facility; a TCA control valve adapted to regulate the flow of the TCA fluid in the TCA flowline; a TCA sample port adapted to enable extraction of a sample of the TCA fluid expelled from the TCA; a TCA check valve adapted to facilitate forward flow of the TCA fluid toward the collection facility in the flowline and to inhibit backflow of the of the TCA fluid toward the TCA in the flowline; a TCA pressure sensor adapted to sense pressure of the TCA; and a TCA control system adapted to: receive, from the TCA pressure sensor, a sensed pressure of the TCA; determine, based on the sensed pressure of the TCA, that a pressure of the TCA is at or below a minimum TCA pressure; and control, in response to determining that the pressure of the TCA is at or below the minimum TCA pressure, the TCA control valve to operate in a closed position.

In some embodiments, the TCA control system is further adapted to: receive, from the TCA pressure sensor, a second sensed pressure of the TCA; determine, based on the second sensed pressure of the TCA, that a second pressure of the TCA is above a maximum TCA pressure; and control, in response to determining that the second pressure of the TCA is above a maximum TCA pressure, the TCA control valve to operate in an opened position. In certain embodiments, the TCA sample port is adapted to enable sampling of TCA fluid downstream of the TCA control valve. In some embodiments, the TCA pressure sensor is adapted to sense pressure of the TCA fluid upstream of the TCA control valve. In certain embodiments, the TCA check valve is disposed downstream of the TCA control valve. In some embodiments, the TCA check valve is disposed on the TCA flowline downstream of the TCA control valve and downstream of the TCA sample port. In certain embodiments, the TCA control valve includes a local TCA control system, and where the TCA control valve, the TCA sample port, the TCA check valve, and the TCA pressure sensor are coupled to a TCA control valve body to define an integrated TCA control valve system. In some embodiments, the minimum TCA pressure is 0 psi. In certain embodiments, the maximum TCA pressure is greater than the minimum TCA pressure. In some embodiments, the maximum TCA pressure is equal to the minimum TCA pressure.

Provided in some embodiments is a method of operating a hydrocarbon well that includes the following: receiving, by a TCA control system of a hydrocarbon well TCA control valve system and from a TCA pressure sensor, a sensed pressure of a TCA of the hydrocarbon well, the TCA control valve system including: a TCA flowline adapted to direct TCA fluid expelled from the TCA to a collection facility; a TCA control valve adapted to regulate the flow of the TCA fluid in the TCA flowline; a TCA sample port adapted to enable extraction of a sample of the TCA fluid expelled from the TCA; a TCA check valve adapted to facilitate forward flow of the TCA fluid toward the collection facility in the flowline and to inhibit backflow of the of the TCA fluid toward the TCA in the flowline; the TCA pressure sensor; and a TCA control system, determining, by the TCA control system based on the sensed pressure of the TCA, that a pressure of the TCA is at or below a minimum TCA pressure; and controlling, by the TCA control system in response to determining that the pressure of the TCA is at or below the minimum TCA pressure, the TCA control valve to operate in a closed position.

In some embodiments, the method further includes: receiving, by the TCA control system from the TCA pressure sensor, a second sensed pressure of the TCA; determining, by the TCA control system based on the second sensed pressure of the TCA, that a second pressure of the TCA is above a maximum TCA pressure; and controlling by the TCA control system in response to determining that the second pressure of the TCA is above a maximum TCA pressure, the TCA control valve to operate in an opened position. In certain embodiments, the TCA sample port is adapted to enable sampling of TCA fluid downstream of the TCA control valve, and the method further includes sampling of TCA fluid downstream of the TCA control valve using the TCA sample port. In some embodiments, the TCA pressure sensor is adapted to sense pressure of the TCA fluid upstream of the TCA control valve, and where the sensed pressure of the TCA is a pressure of the TCA fluid upstream of the TCA control valve. In certain embodiments, the TCA check valve is disposed downstream of the TCA control valve. In some embodiments, the TCA check valve is disposed on the TCA flowline downstream of the TCA control valve and downstream of the TCA sample port. In certain embodiments, the TCA control valve includes a local TCA control system, and where the TCA control valve, the TCA sample port, the TCA check valve, and the TCA pressure sensor are coupled to a TCA control valve body to define an integrated TCA control valve system. In some embodiments, the minimum TCA pressure is 0 psi. In certain embodiments, the maximum TCA pressure is greater than or equal to the minimum TCA pressure.

Provided in some embodiments is a non-transitory computer readable storage medium including program instructions stored thereon that are executable by a processor to perform the following operations for operating a hydrocarbon well: receiving, by a TCA control system of a hydrocarbon well TCA control valve system and from a TCA pressure sensor, a sensed pressure of a TCA of the hydrocarbon well, the TCA control valve system including: a TCA flowline adapted to direct TCA fluid expelled from the TCA to a collection facility; a TCA control valve adapted to regulate the flow of the TCA fluid in the TCA flowline; a TCA sample port adapted to enable extraction of a sample of the TCA fluid expelled from the TCA; a TCA check valve adapted to facilitate forward flow of the TCA fluid toward the collection facility in the flowline and to inhibit backflow of the of the TCA fluid toward the TCA in the flowline; the TCA pressure sensor; and a TCA control system; determining, by the TCA control system based on the sensed pressure of the TCA, that a pressure of the TCA is at or below a minimum TCA pressure; and controlling, by the TCA control system in response to determining that the pressure of the TCA is at or below the minimum TCA pressure, the TCA control valve to operate in a closed position.

Figure 1:
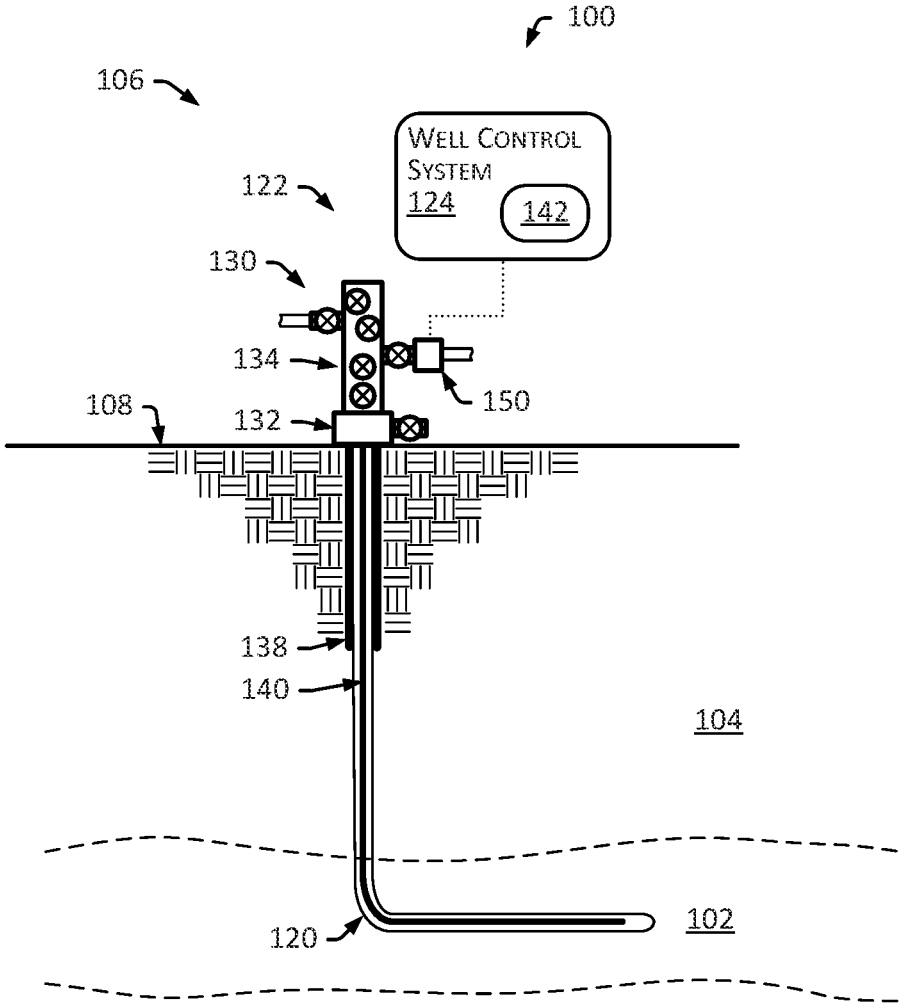
FIG. 1 is diagram that illustrates a well environment in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the scope of the present disclosure as defined by the claims.

DETAILED DESCRIPTION

Described are embodiments of novel systems and methods for automated monitoring and regulation of the TCA pressure. Embodiments include a "smart" TCA control valve that automatically opens or closes based on TCA pressure. For example, the TCA control valve may automatically close when the TCA pressure falls below a threshold, which can prevent the TCA pressure from falling so low that corrective operations, such as pumping, are required. The TCA control valve may automatically open when the TCA pressure is above a threshold, which can prevent the TCA pressure from rising so high that corrective operations, such as manual bleeding, are required. In some embodiments, the TCA valve system includes the following: (1) a TCA control valve (e.g., an automated valve that is positioned to regulate the flow of TCA fluid from a TCA of a well, and that automatically closes to inhibit TCA fluid backflow into the TCA when the TCA pressure is below a predefined lower TCA pressure threshold or that automatically opens when the TCA pressure is above a predefined upper TCA pressure threshold); (2) a TCA sample port (e.g., a needle valve that provides a sealed connection for the collection of TCA fluid samples downstream of the TCA control valve); (3) a TCA flowline (e.g., a piped connection that directs TCA fluid expelled from the TCA to a collection facility, such as dumping pit); and (4) a TCA flowline check valve (e.g., an in-line check valve on the TCA flowline that inhibits backflow of TCA fluid in the TCA flowline). In some embodiments, the TCA pressure thresholds are defined by an operator. The lower TCA pressure threshold (or "TCA closing pressure") may be 0 psi or greater in an effort to maintain a positive pressure in the TCA. In some embodiments, the upper TCA pressure threshold (or "TCA opening pressure") is greater than the lower TCA pressure threshold (e.g., upper TCA pressure threshold=300 psi, and lower TCA pressure threshold=0 psi). This may facilitate the TCA pressure being increased to be above the upper TCA pressure threshold before the TCA control valve is re-opened (after closing). In some embodiments, the upper TCA pressure threshold is the same as the lower TCA pressure threshold (e.g., upper TCA pressure threshold=lower TCA pressure threshold=0 psi). This may facilitate the TCA control valve re-opening (after closing) when the TCA pressure returns to the lower TCA pressure threshold.

FIG. 1 is a diagram that illustrates a well environment 100 in accordance with one or more embodiments. In the illustrated embodiment, the well environment 100 includes a reservoir ("reservoir") 102 located in a subsurface formation ("formation") 104 and a well system ("well") 106.

The formation 104 may include a porous or fractured rock formation that resides beneath the Earth's surface (or "surface") 108. The reservoir 102 may be a hydrocarbon reservoir defined by a portion of the formation 104 that contains (or that is determined to or expected to contain) a subsurface pool of hydrocarbons, such as oil and gas. The formation 104 and the reservoir 102 may each include different layers of rock having varying characteristics, such as varying degrees of permeability, porosity and fluid saturation. In the case of the well 106 being operated as a production well, the well 106 may be a hydrocarbon production well that is operable to facilitate the extraction of hydrocarbons (or "production"), such as oil and gas, from the reservoir 102.

In some embodiments, the well 106 includes a wellbore and systems for extracting production by way of the wellbore. For example, in the illustrated embodiment, the well 106 includes a wellbore 120, a production system 122 and a well control system ("control system") 124. The wellbore 120 may be, for example, a bored hole that extends from the surface 108 into a target zone of the formation 104, such as the reservoir 102. The wellbore 120 may be created, for example, by a drill bit boring through the formation 104. An upper end of the wellbore 120 (e.g., the end of the wellbore 120 terminating at the surface 108) may be referred to as the "up-hole" end of the wellbore 120. A lower end of the wellbore 120 (e.g., terminating in the formation 104) may be referred to as the "down-hole" end of the wellbore 120.

In some embodiments, the production system 122 includes devices that facilitate extraction of production from the reservoir 102 by way of the wellbore 120. For example, in the illustrated embodiment, the production system 122 includes a wellhead system 130 that is operable to regulate fluid pressure and flow in the wellbore 120. In some embodiments, the wellhead system 130 is operable to contain and regulate the pressure and flow of fluids in regions defined by a wellbore casing, wellbore production tubing, or other tubulars disposed in the wellbore 120. For example, in the illustrated embodiment, the wellhead system 130 (located at the surface 108) includes a wellhead 132 and a production tree (or "Christmas tree") 134 coupled to the up-hole ends of a wellbore casing tubular (or "casing") 138, and a wellbore production tubing (or "production tubing") 140 that extends through an interior of the casing 138 and into a portion of the wellbore 120. The casing 138 may be a conduit formed of one or more tubulars that extend into an upper portion of the wellbore 120 and that are fixed (e.g., cemented) within the wellbore 120 to provide structural integrity to the upper portion of the wellbore 120. The casing 138 may define a conduit for directing wellbore fluids and routing the production tubing 140. The production tubing 140 may be a conduit formed of one or more tubulars that extend through the casing 138 and into a lower portion of the wellbore 120. The production tubing 140 may provide a conduit for transporting production fluids from the reservoir 102 to the surface 108. The production tree 134 may include various passages and valves that are operable to regulate the flow of substances in and around the casing 138, the production tubing 140, or other tubulars disposed in the wellbore 120. As described, the production system 122 may include a tubing-casing annulus (TCA) control valve 150 that is operable to regulate fluid communication with a tubing-casing annulus of the well 106.

In some embodiments, the well control system ("control system") 124 includes one or more devices for monitoring and controlling certain operational aspects of the well 106.

For example, the control system 124 may determine and monitor various production parameters of the well 106 (e.g., based on production data provided by sensors located throughout the well 106), determine actions to be taken based on the production parameters, and control devices of the well 106 to enact the actions. For example, the control system 124 may monitor production data 142 (including sensed TCA pressure ($P_{TCA}$)), determine whether the TCA pressure ($P_{TCA}$) is below (or above) a specified threshold pressure, and control the TCA valve 150 to open or close based on the whether the TCA pressure ($P_{TCA}$) is above or below (or above) the specified threshold pressure. In some embodiments, in response to a determination that the sensed TCA pressure ($P_{TCA}$) is at or below a TCA minimum pressure ($P_{TCAMin}$), the control system 124 controls the TCA valve 150 to close. In some embodiments, in response to a determination that the sensed TCA pressure ($P_{TCA}$) is above a TCA maximum pressure ($P_{TCAMax}$), the control system 124 controls the TCA valve 150 to open. In some embodiments, the well control system 124 includes a computer system that is the same or similar that of computer system 1000 described with regard to at least FIG. 5. In some embodiments, the well control system 124 is remote from the TCA valve 150. In some embodiments, the well control system 124 local to the TCA valve 150. For example, the TCA valve may include an onboard control system 124 and power supply that is integrated with the TCA valve 150. This may reduce delays associated with transmission of control signals from a remote location, and may provide a more robust TCA valve 150 that is capable of automatically closing or opening when remote communication or power is unavailable.

Figure 2:
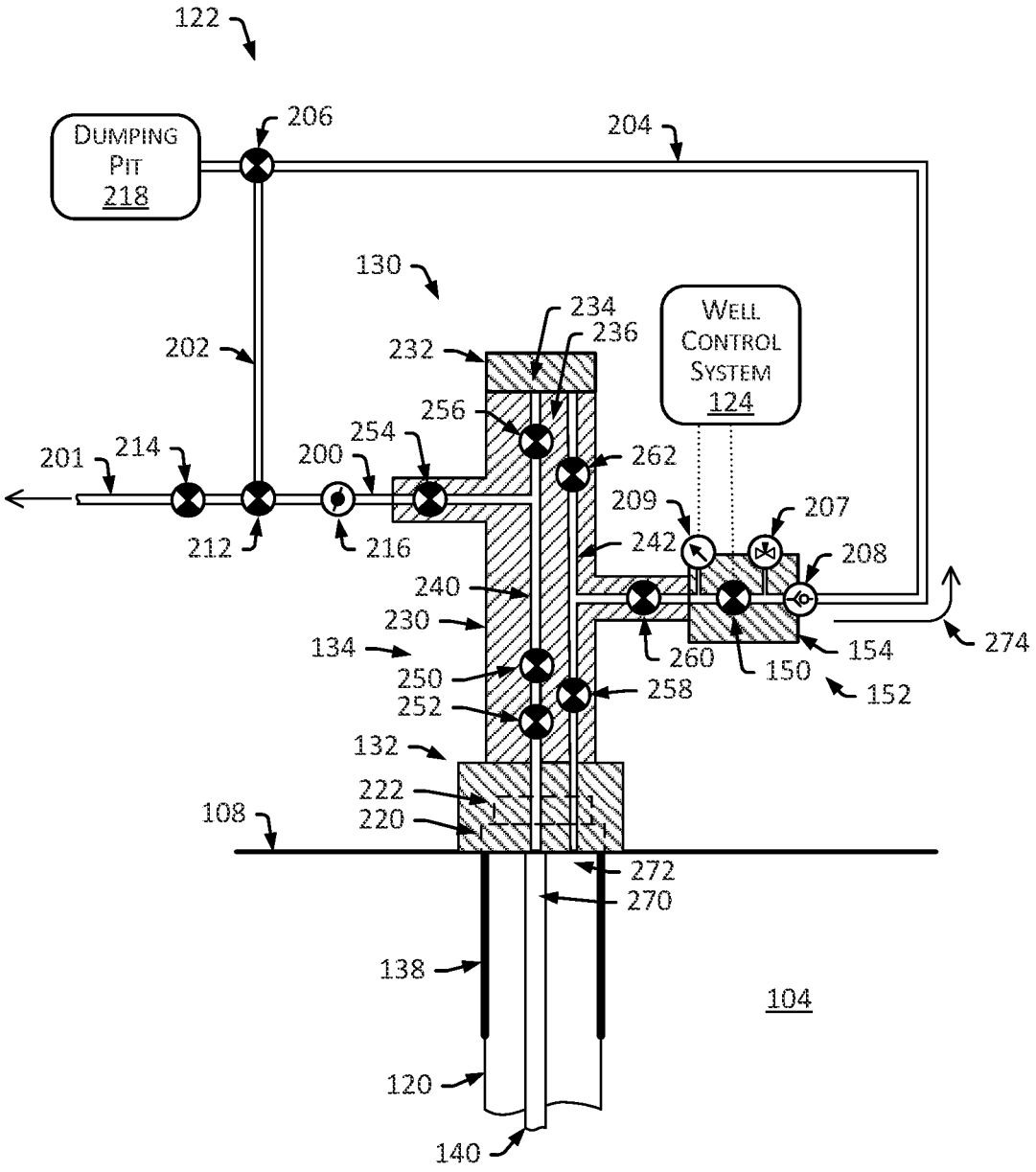
FIG. 2 is a diagram that illustrates a well production system employing a tubing-casing annulus (TCA) control valve in accordance with one or more embodiments.

FIG. 2 is a diagram that illustrates the production system 122 in accordance with one or more embodiments. In the illustrated embodiment, the production system 122 includes the wellhead system 130 (including the wellhead 132 and the production tree 134), a flowline 200, a production flowline 201, a kill line 202, a TCA flowline 204, a TCA return valve 206, a TCA sampling port 207, a TCA flowline check valve 208, a TCA pressure sensor 209, a TCA control valve 150 a kill valve 212, a production valve 214, a choke valve 216, and a dumping pit 218. The wellhead 132 includes a casing head 220 and a tubing head 222. The production tree 134 includes a production tree body (or "tree block") 230, a tree cap 232, production tree conduits 234, and production tree valves 236. The production tree conduits 234 include a production bore 240, and a tubing-casing annulus bore (or "TCA bore") 242. The production tree valves 236 include an upper master valve 250, a lower master valve 252, a production wing valve 254, a production swab valve 256, a TCA master valve 258, a TCA wing valve 260, and a TCA swab valve 262.

The casing head 220 may be a rigid (e.g., metal) flange welded or screwed onto the up-hole end of the casing 132. The casing head 220 may provide an interface for surface pressure control equipment, such as blowout preventers (e.g., for use during well drilling operations) or the production tree 134 (e.g., for use during well production operations). The casing head 220 may include a casing hanger that is operable to support the length of casing 138 suspended in the wellbore 120.

The tubing head 222 may be a rigid (e.g., metal) flange bolted onto the casing head 220. The tubing head 222 may include a tubing hanger that is operable to support the length of production tubing 140 suspending in the casing 138 and the wellbore 120.

The production tree body (or "tree block") 230 may be a rigid (e.g., metal) structure having the production tree conduits 234 formed (e.g., bored) therein to provide paths for routing fluids between surface components and the wellbore 120, the casing 138, the production tubing 140, or other downhole components. The tree cap 232 may be a rigid (e.g., metal) flange that is bolted to an upper end of the production tree body 230. The tree cap 232 may, for example, provide for sealing-off the upper terminations of certain vertical production tree conduits 234, such as the production bore 240 and the TCA bore 242. The tree cap 232 may be removed to, for example, provide access to the vertical production tree conduits 234.

The production conduit (or "production bore") 240 may provide fluid communication with a production conduit 270 defined by the production tubing 140. For example, a first/lower end of the production bore 240 may terminate into a connection with an up-hole end of the production tubing 140 and second/upper end of the production bore 240 may terminate into the flowline 200. During production operations (e.g., when the upper master valve 250, the lower master valve 252 and the production wing valve 254 are open, and the production swab valve 256 is closed), production fluids may flow up the production tubing 140, through the production bore 240, and into the flowline 200, which, in turn, directs the production fluids to production collection, processing or transport facilities.

The TCA annulus conduit (or "TCA bore") 242 may provide fluid communication with a tubing-casing annulus (TCA) 272 of the well 106. The TCA 272 may be defined by an annular region located between an interior wall of the casing 138 and an exterior wall of the production tubing 140 disposed in the casing 138. For example, a first/lower end of the TCA bore 242 may terminate into a connection with an up-hole end of the TCA 272 and second/upper end of the TCA bore 242 may terminate into the TCA flowline 204. During production operations (e.g., when the TCA master valve 258 and the TCA wing valve 260 are opened, and the TCA swab valve 262 is closed) TCA fluid may flow up the TCA 272, through the TCA bore 242, and into the TCA flowline 204, which directs the TCA fluid to collection, processing or transport facilities, such as the dumping pit 216.

In some embodiments, the production tree valves 236 are integrated into or coupled to the production tree body 230. The production tree valves 236 may include one or more valves that are operable to provide for regulating pressure and flow across the production tree conduits 234. In some embodiments, the upper master valve 250 and the lower master valve 252 are gate valves that are operable (e.g., to open or close) to regulate (e.g., to facilitate or inhibit) the flow of substances between the production bore 240 and the production tubing 140. Although one master valve may be employed in some embodiments, two or more master valves are employed for the purpose of redundancy. In some embodiments, the production wing valve 254 is a gate valve that is operable (e.g., to open or close) to regulate (e.g., to facilitate or inhibit) the flow of substances between the production bore 240 and the flowline 200. In some embodiments, the production swab valve 256 is a gate valve that is operable (e.g., to open or close) to regulate (e.g., to facilitate or inhibit) access to the production bore 240 (and the production conduit 270 defined by the production tubing 140) or to regulate (e.g., facilitate or inhibit) the flow of substances between the production bore 240 and components coupled to the upper end of the production tree body 230 (e.g., during injection operations).

In some embodiments, the TCA master valve 258 is a gate valve that is operable (e.g., to open or close) to regulate (e.g., to facilitate or inhibit) the flow of substances between the TCA bore 242 and the TCA 272. In some embodiments, the TCA wing valve 260 is a gate valve that is operable (e.g., to open or close) to regulate (e.g., to facilitate or inhibit) the flow of substances between the TCA bore 242 and the TCA flowline 204. In some embodiments, the TCA swab valve 262 is a gate valve that is operable (e.g., to open or close) to regulate (e.g., to facilitate or inhibit) access to the TCA bore 242 (and the TCA 272) or to regulate (e.g., facilitate or inhibit) the flow of substances between the TCA bore 242 and components coupled to the upper end of the production tree body 230 (e.g., during workover operations).

In some embodiments, the flowline 200 is a conduit (e.g., a cylindrical pipe) that provides for directing the flow of substances (e.g., production) out of (or into) the production bore 240. In some embodiments, the kill line 202 is a conduit (e.g., a cylindrical pipe) that provides for directing the flow of "kill" substances (e.g., relatively high density mud) into, or out of, the production bore 240 or the TCA bore 242. In some embodiments, the TCA flowline 204 is a conduit (e.g., a cylindrical pipe) that provides for directing the flow of substances (e.g., TCA fluid) out of the TCA bore 242.

In some embodiments, the TCA sampling port 207 is an access port that provides for sampling of TCA fluid that is expelled from the TCA bore 242 (e.g., through the TCA wing valve 260 and the TCA control valve 150). For example, the TCA sampling port 207 may be a needle valve (or similar fluid communication device) that is coupled to the TCA flowline 204 to enable removal of a sample of the TCA fluid resident in the TCA flowline 204. During operation, such a needle valve may be opened to selectively enable a sample of the TCA fluid to be expelled from the TCA flowline 204, and then be closed. The sample of the TCA fluid may be captured in a container (e.g., a TCA sample bottle) for transport to, for example, a laboratory for analysis.

In some embodiments, the TCA return valve 206 provides for directing flow between the kill line 202, the TCA flowline 204 and the dumping pit 218. For example, the TCA return valve 206 may be a multi-way valve, such as a three-way valve (e.g., that provides for selective directing of flow between the kill line 202 and the TCA flowline 204, between the kill line 202 and the dumping pit 218, or between the TCA flowline 204 and the dumping pit 218), or a two-way valve (e.g., that enables selective directing of flow between the kill line 202 and the dumping pit 218, or between the TCA flowline 204 and the dumping pit 218).

In some embodiments, the TCA flowline check valve 208 promotes the flow of substances "up" the TCA flowline 204 and inhibits the flow of substances "down" the TCA flowline 204. The TCA flowline check valve 208 may be a one-way valve that installed in the TCA flowline 204 to allow the flow of substances away from the TCA wing valve 260 (and toward the TCA return valve 206 and the dumping pit 218, as indicated by arrow 274), and to inhibit the flow of substances toward the TCA wing valve 260 and away from the TCA return valve 206 and the dumping pit 218). This may ensure that TCA fluid that is expelled from the TCA bore 242 (or the TCA 272) by way of the TCA wing valve 260 are not returned into the TCA bore 242 (or the TCA 272), and are, instead, directed for sampling, collection, or disposal. Consistent with flow of TCA fluid in the TCA flowline 204 from the production tree 134 and toward the dumping pit 218 (in the direction of arrow 274), the relative term "downstream" may refer to being in the promoted direction of flow and the relative term "upstream" may refer to being in the inhibited direction of flow. For example, referring to FIG. 2 and the flow in the direction of arrow 274 promoted by the TCA flowline check valve 208, the TCA sample port 207 may be operable to provide for sampling of TCA fluid downstream of the TCA control valve 150, the TCA pressure sensor 209 may be operable to sense pressure of the TCA fluid upstream of the TCA control valve 150, the TCA check valve 208 may be disposed on the TCA flowline 204 downstream of the TCA control valve 150 and the TCA sample port 207.

In some embodiments, the TCA pressure sensor 209 includes a pressure sensing device (e.g., a pressure transducer) that is operable to sense fluid pressure at or near the interface between the TCA bore 242 and the TCA flowline 204, which may be indicative of the fluid pressure in the TCA bore 242 (or the TCA 272). For example, the TCA pressure sensor 209 may include an electronic transducer that is operable to sense TCA fluid pressure upstream of the TCA control valve 150 (e.g., downstream of the TCA wing valve 260 and upstream of the TCA control valve 150), and send, to the well control system 124, a pressure signal that is indicative of the sensed TCA fluid pressure. As described, the pressure signal may be used to determine the TCA fluid pressure within the TCA bore 242 (or the TCA 272), which may, in turn, be used to as a basis for operating (e.g., opening or closing) the TCA control valve 150 to maintain a desirable TCA fluid pressure within the TCA bore 242 and the TCA 272.

In some embodiments, the TCA control valve 150 is a valve that is operable (e.g., to open or close) to regulate (e.g., to facilitate or inhibit) the flow of substances along the TCA flowline 204. For example, the TCA control valve 150 may be an actuated gate valve that is located in-line on the TCA flowline 204. The TCA control valve 150 may be opened (e.g., fully or partially opened) to enable the flow of TCA fluid along the TCA flowline 204 (e.g., in the direction of arrow 270). The TCA control valve 150 may be closed (e.g., fully closed) to inhibit the flow of TCA fluid along the TCA flowline 204. As described, the TCA control valve 150 may be an electronically actuated gate valve that can be controlled to automatically opened or closed to facilitate or inhibit, respectively, the flow of TCA fluid along the TCA flowline 204. For example, the TCA control valve 150 may be an automated valve that is automatically opened or closed to facilitate or inhibit, respectively, the flow of TCA fluid along the TCA flowline 204 in response to control signals provided by the well control system 124.

In some embodiments, an integrated TCA control valve system 152 is defined some or all of a TCA control valve body 154, the TCA control valve 150, the TCA pressure sensor 209, the TCA sampling port 207 or the TCA flowline check valve 208. For example, in the illustrated embodiment, the TCA control valve 150, the TCA pressure sensor 209, the TCA sampling port 207 and the TCA flowline check valve 208 are integrated with the TCA control valve body 154. The TCA control valve body 154 may have a flange that can be bolted to a complementary flange of the TCA wing valve 260 (or directly to a complementary flange the production tree body 230 in place of the TCA wing valve 260). Such an arrangement may simplify installation, removal, replacement or maintenance of the components of the integrated TCA control valve system 152. Although the illustrated embodiment includes an integrated unit, some or all of the components may be provided separately in similar relative locations (e.g., upstream/downstream from one another). For example, an embodiment may include the TCA flowline check valve 208 may be provided on a portion of the TCA flowline 204 that is downstream of the TCA control valve body 154.

In some embodiments the TCA control valve 150 is operable to maintain a TCA pressure ($P_{TCA}$) (e.g., to maintain the fluid pressure in the TCA bore 242 or the TCA 272) at a desirable level. For example, where it is desirable to keep the TCA pressure ($P_{TCA}$) within an acceptable range defined by a minimum pressure (e.g., $P_{TCAMin}$=0 psi), the TCA control valve 150 may be automatically closed in response to determining that the TCA pressure ($P_{TCA}$) is at or below the minimum pressure (e.g., when $P_{TCA}$≤0 psi). This may inhibit a sudden loss of TCA pressure ($P_{TCA}$) and may, in turn, prevent the need for corrective operations, such as pumping by an Electronic Submersible Pump (ESP) to bring the TCA pressure ($P_{TCA}$) into the acceptable range. Where it is desirable to keep the TCA pressure ($P_{TCA}$) within an acceptable range defined by a maximum pressure (e.g., $P_{TCAMax}$=300 psi) the TCA control valve 150 may be automatically opened in response to determining that the TCA pressure ($P_{TCA}$) is above the maximum pressure (e.g., when $P_{TCA}$>300 psi). This may provide for bleeding off of the TCA fluid (e.g., through the TCA flowline 204, in the direction of arrow 274)) to avoid an undesirably high TCA pressure ($P_{TCA}$). In an embodiment in which the minimum and maximum pressure are the same (e.g., $P_{TCAMax}$=$P_{TCAMin}$=0 psi) the TCA wing valve 260 may be automatically closed in response to determining that the TCA pressure ($P_{TCA}$) is at or below the minimum pressure (e.g., when $P_{TCA}$≤0 psi) and the TCA wing valve 260 may be automatically opened in response to determining that the TCA pressure ($P_{TCA}$) is above the maximum pressure (e.g., when $P_{TCA}$>0 psi). Although certain embodiments are described with regard to example maximum and minimum TCA pressures, embodiments may employ any suitable maximum and minimum TCA pressures.

In some embodiments, the kill valve 212 is a valve that is operable to direct flow between the kill line 202, the flowline 200 and the production flowline 201. For example, the kill valve 212 may be a multi-way valve, such as a two-way valve (e.g., that enables selective directing of flow between the flowline 200 and the production flowline 201, or between the kill line 202 and the flowline 200). In some embodiments, the production valve 214 is a gate valve that is operable (e.g., to open or close) to regulate (e.g., to facilitate or inhibit) the flow of substances from the flowline 200 along the production flowline 201. In some embodiments, the choke valve 216 is choke valve that is operable to regulate the flowrate or pressure drop of substances (e.g., production) flowing through the flowline 200. In some embodiments, the dumping pit 218 is a facility (e.g., a reservoir) that provides for collection and storage of well fluids, such as mud (e.g., drilling mud or kill mud), production fluid, TCA fluid, or the like.

In some embodiments, such as during typical production operations, the upper master valve 250 and the lower master valve 252 are opened to enable production fluid to flow from the production tubing 140 into the production bore 240, the production wing valve 254 is opened to enable production fluid to flow from the production bore 240 into the flowline 200, the choke valve 216 is set to maintain the flowrate or pressure drop of production flowing through the flowline 200 at a desired level, the kill valve 212 is set to enable communication between the flowline 200 and the production flowline 201 (e.g., to enable production to flow from the flowline 200 into the production flowline 201), the production valve 214 is opened to enable production fluid to flow along the production flowline 215 to downstream facilities, such as production processing, storage or transport facilities (e.g., to a production pipeline), the TCA return valve 206 is set to enable communication between the TCA flowline 204 and the dumping pit 218 (e.g., to enable directing of expelled TCA fluid into the dumping pit 218), the TCA master valve 258 is opened to enable TCA fluid to flow from the TCA 272 into the TCA bore 242, the TCA wing valve 260 to enable TCA fluid to flow from TCA bore 242 to the TCA control valve 150, and the TCA control valve 150 is operated to regulate the flow of TCA fluid into the TCA flowline 204.

In some embodiment, during typical production operations, the TCA sampling port 207 is normally closed to inhibit the release of TCA fluid by way of the TCA sampling port 207 and to inhibit bleeding off of TCA fluid pressure ($P_{TCA}$). During a TCA fluid sampling operation, the TCA sampling port 207 may be opened (e.g., while production operations are ongoing) to facilitate the release and capture of TCA fluid by way of the TCA sampling port 207. The TCA fluid released (or "TCA sample") may be captured in a container (e.g., in a TCA sample bottle), and the container and the TCA sample may be transported to, for example, a laboratory, where the TCA sample is analyzed. In such an embodiment, if it is determined that the TCA fluid pressure ($P_{TCA}$) has dropped to or below the predetermined minimum TCA pressure (e.g., 0 psi) during the TCA fluid sampling operation, the TCA control valve 150 may be automatically closed. This may inhibit a sudden loss of TCA pressure ($P_{TCA}$) during the TCA fluid sampling operation. In some embodiments, if it is determined that the TCA fluid pressure ($P_{TCA}$) has increased to be above the predetermined maximum TCA pressure (e.g., 300 psi), the TCA control valve 150 may be automatically opened. This may promote a return of TCA pressure and inhibit an undesirably high TCA pressure.

Figure 3:
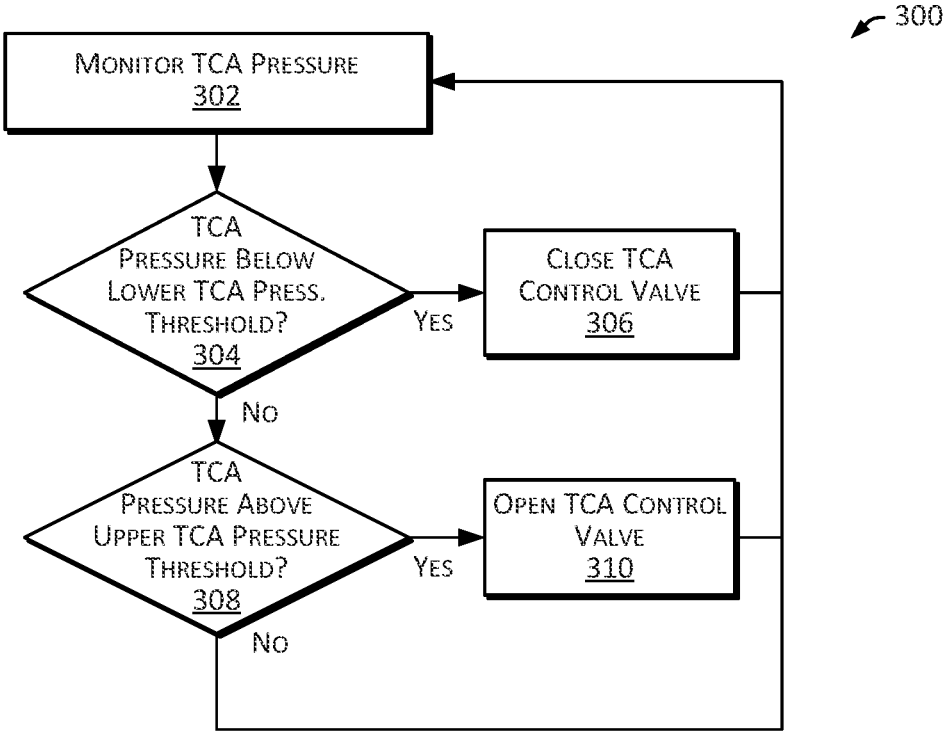
FIG. 3 is a flowchart that illustrates a method of operating a hydrocarbon well in accordance with one or more embodiments.

FIG. 3 is a flowchart that illustrates a method 300 of operating a hydrocarbon well in accordance with one or more embodiments. In the context of the well 106, some or all of the operations of method 300 may be performed by the well control system 124, well personnel, or another operator of the well 106.

In some embodiments, method 300 includes monitoring TCA pressure (block 302). This may include monitoring the fluid pressure of the TCA conduit, including the TCA, the TCA bore, or other portion of the TCA flow path upstream of a TCA control valve. For example, monitoring TCA pressure may include the control system 124 receiving an indication of TCA pressure upstream of the TCA control valve 150 that is sensed by the TCA pressure sensor 209, and determining a current TCA pressure (e.g., 200 psi) based on the indication of TCA pressure upstream.

In some embodiments, method 300 includes determining whether the TCA pressure is below a lower TCA pressure threshold (block 304). This may include determining whether the TCA pressure is at or below a predefined minimum TCA pressure. For example, where a minimum TCA pressure is defined as 0 psi ($P_{TCAMin}$=0 psi) and the current TCA pressure is determined to be 200 psi, the control system 124 may determine that the TCA pressure is not below the lower TCA pressure threshold. Where a minimum TCA pressure is defined as 0 psi ($P_{TCAMin}$=0 psi) and the current TCA pressure is determined to be 0 psi (or less), the control system 124 may determine that the TCA pressure is below the lower TCA pressure threshold.

In some embodiments, method 300 includes, in response to determining that the TCA pressure is below a lower TCA pressure threshold, closing a TCA control valve (block 306).

Where the TCA control valve is in an opened state, this may include controlling the TCA control valve to move from the opened state to a closed state. Where the TCA control valve is in a closed state, this may include controlling the TCA control valve to remain in the closed state. For example, in response to determining that the TCA pressure is below the minimum TCA pressure (e.g., $P_{TCA} \leq 0$ psi), the control system 124 may control an electronic actuator of the TCA control valve 150 to move a gate of the TCA control valve 150 into the closed state (or, if the TCA control valve is already in the closed state 150, to maintain the gate of the TCA control valve 150 in the closed state). Such control may provide for automatically closing the TCA control valve 150 (without manual intervention) in response to the TCA pressure falling below a predefined TCA pressure.

In some embodiments, method 300 includes determining whether the TCA pressure is above an upper TCA pressure threshold (block 308). This may include determining whether the TCA pressure is above a predefined maximum TCA pressure. For example, where a maximum TCA pressure is defined as 300 psi ($P_{TCAMax}$=300 psi) and the current TCA pressure is determined to be 200 psi, the control system 124 may determine that the TCA pressure is not above the upper TCA pressure threshold. Where a maximum TCA pressure is defined as 300 psi ($P_{TCAMax}$=300 psi) and the current TCA pressure is determined to be greater than 300 psi, the control system 124 may determine that the TCA pressure is above the upper TCA pressure threshold.

In some embodiments, method 300 includes, in response to determining that the TCA pressure is above an upper TCA pressure threshold, opening a TCA control valve (block 310). Where the TCA control valve is in a closed state, this may include controlling the TCA control valve to move from the closed state to an opened state. Where the TCA control valve is in an opened state, this may include controlling the TCA control valve to remain in the opened state. For example, in response to determining that the TCA pressure is above the maximum TCA pressure (e.g., $P_{TCA}$>300 psi), the control system 124 may control an electronic actuator of the TCA control valve 150 to move the gate of the TCA control valve 150 into the opened state (or, if the TCA control valve is already in the opened state 150, to maintain the gate of the TCA control valve 150 in the opened state). Such control may provide for automatically opening the TCA control valve 150 (without manual intervention) in response to the TCA pressure exceeding a maximum TCA pressure. This may provide for a bleeding-off of the TCA fluid that avoids an undesirably high TCA pressure.

Figure 4:
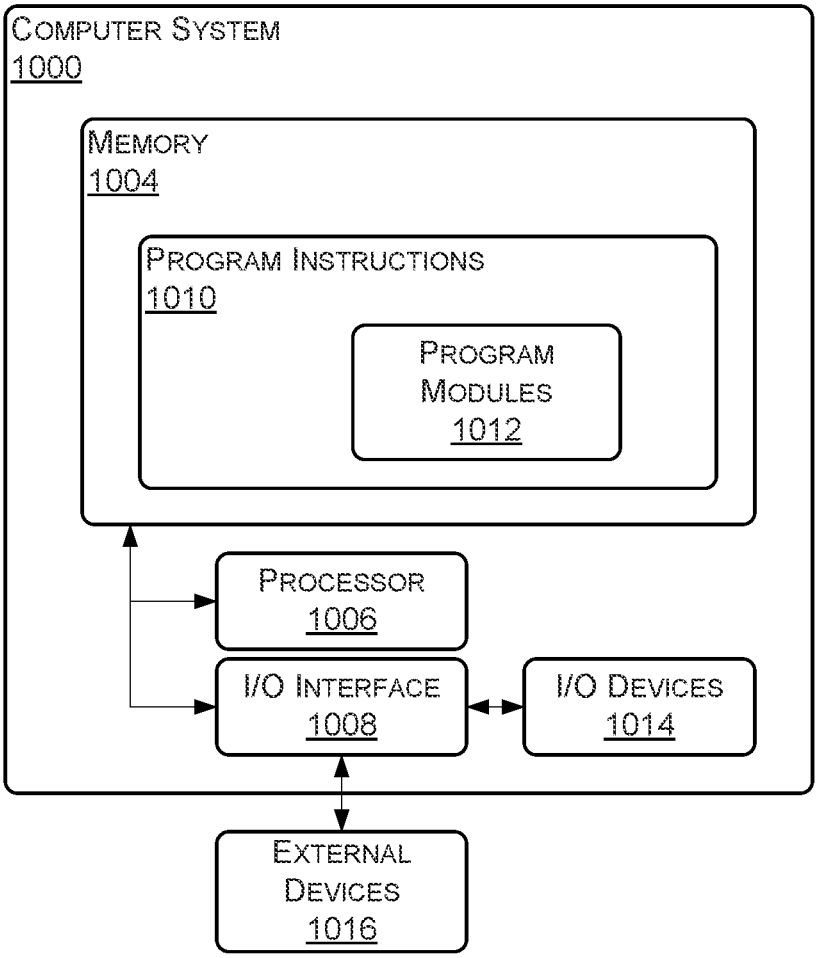
FIG. 4 is a diagram that illustrates an example computer system in accordance with one or more embodiments.

FIG. 4 is a diagram that illustrates an example computer system (or "system") 1000 in accordance with one or more embodiments. The system 1000 may include a memory 1004, a processor 1006 and an input/output (I/O) interface 1008. The memory 1004 may include non-volatile memory (e.g., flash memory, read-only memory (ROM), programmable read-only memory (PROM), erasable programmable read-only memory (EPROM), electrically erasable programmable read-only memory (EEPROM)), volatile memory (e.g., random access memory (RAM), static random access memory (SRAM), synchronous dynamic RAM (SDRAM)), or bulk storage memory (e.g., CD-ROM or DVD-ROM, hard drives). The memory 1004 may include a non-transitory computer-readable storage medium having program instructions 1010 stored thereon. The program instructions 1010 may include program modules 1012 that are executable by a computer processor (e.g., the processor 1006) to cause the functional operations described here, such as those described with regard to the well control system 124 (or another operator of the well 106) or the method 300.

The processor 1006 may be any suitable processor capable of executing program instructions. The processor 1006 may include a central processing unit (CPU) that carries out program instructions (e.g., the program instructions of the program modules 1012) to perform the arithmetical, logical, or input/output operations described. The processor 1006 may include one or more processors. The I/O interface 1008 may provide an interface for communication with one or more I/O devices 1014, such as a joystick, a computer mouse, a keyboard, or a display screen (e.g., an electronic display for displaying a graphical user interface (GUI)). The I/O devices 1014 may include one or more of the user input devices. The I/O devices 1014 may be connected to the I/O interface 1008 by way of a wired connection (e.g., an Industrial Ethernet connection) or a wireless connection (e.g., a Wi-Fi connection). The I/O interface 1008 may provide an interface for communication with one or more external devices 1016. In some embodiments, the I/O interface 1008 includes one or both of an antenna and a transceiver. The external devices 1016 may include, for example, the TCA pressure sensor 209 or the TCA control valve 150.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

It will be appreciated that the processes and methods described here are example embodiments of processes and methods that may be employed in accordance with the techniques described here. The processes and methods may be modified to facilitate variations of their implementation and use. The order of the processes and methods and the operations provided may be changed, and various elements may be added, reordered, combined, omitted, modified, and so forth. Portions of the processes and methods may be implemented in software, hardware, or a combination of software and hardware. Some or all of the portions of the processes and methods may be implemented by one or more of the processors/modules/applications described here.

As used throughout this application, the word "may" is used in a permissive sense (that is, meaning having the potential to), rather than the mandatory sense (that is, meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (for example, by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A hydrocarbon well tubing-casing annulus (TCA) control valve system comprising:

a TCA flowline configured to direct TCA fluid expelled from a TCA of a hydrocarbon well system to a collection facility;

a TCA control valve configured to regulate the flow of the TCA fluid in the TCA flowline;

a TCA sample port configured to enable extraction of a sample of the TCA fluid expelled from the TCA;

a TCA check valve configured to facilitate forward flow of the TCA fluid toward the collection facility in the flowline and to inhibit backflow of the of the TCA fluid toward the TCA in the flowline;

a TCA pressure sensor configured to sense pressure of the TCA; and a TCA control system configured to:

receive, from the TCA pressure sensor, a sensed pressure of the TCA;

determine, based on the sensed pressure of the TCA, that a pressure of the TCA is at or below a minimum TCA pressure; and control, in response to determining that the pressure of the TCA is at or below the minimum TCA pressure, the TCA control valve to operate in a closed position.

2. The system of claim 1, wherein the TCA control system is further configured to:

receive, from the TCA pressure sensor, a second sensed pressure of the TCA;

determine, based on the second sensed pressure of the TCA, that a second pressure of the TCA is above a maximum TCA pressure; and control, in response to determining that the second pressure of the TCA is above a maximum TCA pressure, the TCA control valve to operate in an opened position.

3. The system of claim 1, wherein the TCA sample port is configured to enable sampling of TCA fluid downstream of the TCA control valve.

4. The system of claim 1, wherein the TCA pressure sensor is configured to sense pressure of the TCA fluid upstream of the TCA control valve.

5. The system of claim 1, wherein the TCA check valve is disposed downstream of the TCA control valve.

6. The system of claim 1, wherein the TCA check valve is disposed on the TCA flowline downstream of the TCA control valve and downstream of the TCA sample port.

7. The system of claim 1, wherein the TCA control valve comprises a local TCA control system, and wherein the TCA control valve, the TCA sample port, the TCA check valve, and the TCA pressure sensor are coupled to a TCA control valve body to define an integrated TCA control valve system.

8. The system of claim 1, wherein the minimum TCA pressure is 0 pounds per square inch (psi).

9. The system of claim 1, wherein the maximum TCA pressure is greater than the minimum TCA pressure.

10. The system of claim 1, wherein the maximum TCA pressure is equal to the minimum TCA pressure.

11. A method of operating a hydrocarbon well, the method comprising:

receiving, by a tubing-casing annulus (TCA) control system of a hydrocarbon well TCA control valve system and from a TCA pressure sensor, a sensed pressure of a TCA of the hydrocarbon well, the TCA control valve system comprising:

a TCA flowline configured to direct TCA fluid expelled from the TCA to a collection facility;

a TCA control valve configured to regulate the flow of the TCA fluid in the TCA flowline;

a TCA sample port configured to enable extraction of a sample of the TCA fluid expelled from the TCA;

a TCA check valve configured to facilitate forward flow of the TCA fluid toward the collection facility in the flowline and to inhibit backflow of the of the TCA fluid toward the TCA in the flowline;

the TCA pressure sensor; and a TCA control system;

determining, by the TCA control system based on the sensed pressure of the TCA, that a pressure of the TCA is at or below a minimum TCA pressure; and controlling, by the TCA control system in response to determining that the pressure of the TCA is at or below the minimum TCA pressure, the TCA control valve to operate in a closed position.

12. The method of claim 11, wherein the method further comprises:

receiving, by the TCA control system from the TCA pressure sensor, a second sensed pressure of the TCA;

determining, by the TCA control system based on the second sensed pressure of the TCA, that a second pressure of the TCA is above a maximum TCA pressure; and controlling by the TCA control system in response to determining that the second pressure of the TCA is above a maximum TCA pressure, the TCA control valve to operate in an opened position.

13. The method of claim 11, wherein the TCA sample port is configured to enable sampling of TCA fluid downstream of the TCA control valve, and the method further comprising sampling of TCA fluid downstream of the TCA control valve using the TCA sample port.

14. The method of claim 11, wherein the TCA pressure sensor is configured to sense pressure of the TCA fluid upstream of the TCA control valve, and wherein the sensed pressure of the TCA is a pressure of the TCA fluid upstream of the TCA control valve.

15. The method of claim 11, wherein the TCA check valve is disposed downstream of the TCA control valve.

16. The method of claim 11, wherein the TCA check valve is disposed on the TCA flowline downstream of the TCA control valve and downstream of the TCA sample port.

17. The method of claim 11, wherein the TCA control valve comprises a local TCA control system, and wherein the TCA control valve, the TCA sample port, the TCA check valve, and the TCA pressure sensor are coupled to a TCA control valve body to define an integrated TCA control valve system.

18. The method of claim 11, wherein the minimum TCA pressure is 0 pounds per square inch (psi).

19. The method of claim 11, wherein the maximum TCA pressure is greater than or equal to the minimum TCA pressure.

20. A non-transitory computer readable storage medium comprising program instructions stored thereon that are executable by a processor to perform the following operations for operating a hydrocarbon well:

receiving, by a tubing-casing annulus (TCA) control system of a hydrocarbon well TCA control valve system and from a TCA pressure sensor, a sensed pressure of a TCA of the hydrocarbon well, the TCA control valve system comprising:

a TCA flowline configured to direct TCA fluid expelled from the TCA to a collection facility;

a TCA control valve configured to regulate the flow of the TCA fluid in the TCA flowline;

a TCA sample port configured to enable extraction of a sample of the TCA fluid expelled from the TCA;

a TCA check valve configured to facilitate forward flow of the TCA fluid toward the collection facility in the flowline and to inhibit backflow of the of the TCA fluid toward the TCA in the flowline;

the TCA pressure sensor; and a TCA control system;

determining, by the TCA control system based on the sensed pressure of the TCA, that a pressure of the TCA is at or below a minimum TCA pressure; and controlling, by the TCA control system in response to determining that the pressure of the TCA is at or below the minimum TCA pressure, the TCA control valve to operate in a closed position.

* * * * *